US009452455B2

(12) United States Patent
An et al.

(10) Patent No.: US 9,452,455 B2
(45) Date of Patent: Sep. 27, 2016

(54) CLEANING DEVICE FOR CONTAMINATION OF CONTACT OF ELECTROMAGNETIC CONTACTOR

(71) Applicant: LSIS CO., LTD., Anyang-si, Gyeonggi-do (KR)

(72) Inventors: Jung Sik An, Seoul (KR); Hyun Woo Joo, Chungcheongbuk-do (KR)

(73) Assignee: LSIS CO., LTD., Anyang-si (KR)

( * ) Notice: Subject to any disclaimer, the term of this patent is extended or adjusted under 35 U.S.C. 154(b) by 163 days.

(21) Appl. No.: 14/165,166

(22) Filed: Jan. 27, 2014

(65) Prior Publication Data

US 2015/0013085 A1 Jan. 15, 2015

(30) Foreign Application Priority Data

Jul. 8, 2013 (KR) ..... 10-2013-0079885

(51) Int. Cl.

| | |
|---|---|
| ***H01H 9/02*** | (2006.01) |
| ***H01H 13/04*** | (2006.01) |
| ***B08B 7/00*** | (2006.01) |
| ***H01H 1/60*** | (2006.01) |
| ***H01H 9/44*** | (2006.01) |
| ***H01H 50/04*** | (2006.01) |
| *H01H 50/54* | (2006.01) |

(52) U.S. Cl.

CPC ..... *B08B 7/00* (2013.01); *H01H 1/605* (2013.01); *H01H 9/443* (2013.01); *H01H 50/045* (2013.01); *H01H 50/546* (2013.01)

(58) Field of Classification Search

CPC .... H01H 1/605; H01H 9/443; H01H 50/045; H01H 50/546; B08B 7/00

USPC ..... 335/202

See application file for complete search history.

(56) References Cited

U.S. PATENT DOCUMENTS

| | | | | |
|---|---|---|---|---|
| 4,134,026 | A | 1/1979 | Sone et al. | |
| 2005/0068133 | A1* | 3/2005 | Romanik | H01H 36/0033 335/207 |
| 2007/0205753 | A1* | 9/2007 | Hau | G01R 3/00 324/756.02 |
| 2011/0132396 | A1* | 6/2011 | Humphrey | B08B 1/00 134/6 |
| 2012/0181953 | A1 | 7/2012 | Hsu et al. | |

(Continued)

FOREIGN PATENT DOCUMENTS

| | | |
|---|---|---|
| CN | 87201238 | 12/1987 |
| CN | 1071782 | 5/1993 |

(Continued)

OTHER PUBLICATIONS

European Patent Office Application Serial No. 14152694.7, Search Report dated Dec. 11, 2014, 6 pages.

*Primary Examiner* — Bernard Rojas

(74) *Attorney, Agent, or Firm* — Lee Hong Degerman Kang & Waimey; Jonathan Kang; Jeffrey Lotspeich

(57) ABSTRACT

The present invention relates to a device for cleaning contaminants on a contact portion of an electromagnetic contactor, and more particularly, a device for cleaning contaminants on a contact portion of an electromagnetic contactor in which a magnetic force the acting direction of which is changed in time is generated to the outside of the electromagnetic contactor for cleaning contaminants generated at a contact portion thereof with an arc extinguishing method, thereby effectively and broadly performing the cleaning of contaminants.

5 Claims, 5 Drawing Sheets

(56) References Cited

U.S. PATENT DOCUMENTS

| | | | | |
|---|---|---|---|---|
| 2013/0061875 | A1* | 3/2013 | Woodruff | C25D 17/001 134/6 |
| 2013/0243473 | A1* | 9/2013 | Noguchi | G03G 15/0131 399/101 |

FOREIGN PATENT DOCUMENTS

| | | |
|---|---|---|
| CN | 201985041 | 9/2011 |
| CN | 102592881 | 7/2012 |
| CN | 202487498 | 10/2012 |
| EP | 1168392 | 1/2002 |

* cited by examiner

CLEANING DEVICE FOR CONTAMINATION OF CONTACT OF ELECTROMAGNETIC CONTACTOR

CROSS-REFERENCE TO RELATED APPLICATIONS

Pursuant to 35 U.S.C. §119(a), this application claims the benefit of earlier filing date and right of priority to Korean Patent Application No. 10-2013-0079885, filed on Jul. 8, 2013, the contents of which is incorporated by reference herein in its entirety.

BACKGROUND OF THE INVENTION

1. Field of the Invention

The present invention relates to a device for cleaning contaminants on a contact portion of an electromagnetic contactor, and more particularly, a device for cleaning contaminants on a contact portion of an electromagnetic contactor in which a magnetic force the acting direction of which is changed in time is generated to the outside of the electromagnetic contactor for cleaning contaminants generated at a contact portion thereof with an arc extinguishing method, thereby effectively and broadly performing the cleaning of contaminants.

2. Description of the Related Art

In general, electromagnetic contactor is a type of electrical circuit switching device for transferring a mechanical drive and current signal using the principle of an electromagnet, and provided in various industrial facilities, machines, vehicles, and the like. FIG. 1 is a longitudinal cross-sectional view illustrating an electromagnetic contactor in the related art used in electric vehicles. The configuration of an electromagnetic contactor for electric vehicles may include a case 1, a housing 2, a stationary contact point 3 and a movable contact point 4, and typically further include electrical actuators 5, 6, 7, 8 for driving the movable contact point 4 to control the switching of contact points by an electrical signal.

Contaminants are adhered to the contact portion (a stationary contact point and a movable contact point) of the electromagnetic contactor. The contaminants may increase a contact resistance of the contact portion and thus a surface thereof can be clearly maintained through a cleaning or conditioning operation.

A conventional method used for the cleaning operation has been carried out in such a manner that an arc is artificially generated on the contact portion to burn contaminants existing on an electrode surface thereof. FIG. 2 is a view illustrating an operation diagram according to the cleaning method. FIG. 2 is a transverse cross-sectional view illustrating a contact portion of an electromagnetic contactor in the related art. A magnetic body for arc extinction 9 is provided in a direction perpendicular to the stationary contact point 3 and movable contact point 4. An arc is generated in such a form that it is started from any one (indicated by ⊙) of the stationary contact point 3 and enters into the other one (indicated by ⊗) of the stationary contact point 3 while forming an arc shape. Here, a magnetic force (B) flowing from the top to bottom on the drawing is generated, and an arc is formed with the flow of a current (I) and thus a force according to the Fleming's left hand rule (F=B×I) is generated between the stationary contact point 3 and movable contact point 4. Accordingly, the ⊙ indicated electrode receives a force (F) exerted in the "→" direction and ⊗ indicated electrode receives a force (F') in the "←" direction, thereby cleaning contaminants on a surface of the electrode.

However, according to a contaminant cleaning method in the related art, the acting direction of a magnetic force (B) is fixed in a predetermined direction so as to generate the magnetic force (B) due to the magnetic body for arc extinction 9 fixed and provided within the electromagnetic contactor and thus forces (F, F') generated on the arc is also exerted only in a particular direction (horizontal direction (← or →) in FIG. 2), and as a result, the cleaning range of contaminants is restricted, thereby causing a problem in which there is a limit in the cleaning performance.

SUMMARY OF THE INVENTION

The present invention is contrived to solve the foregoing problems, and an aspect of the present invention is to provide a device for cleaning contaminants on a contact portion of an electromagnetic contactor in which a magnetic force the acting direction of which is changed in time is generated to the outside of the electromagnetic contactor for cleaning contaminants generated at a contact portion thereof with an arc extinguishing method, thereby effectively and broadly performing the cleaning of contaminants.

A device for cleaning contaminants on a contact portion of an electromagnetic contactor according to an embodiment of the present invention may include a housing; a drive unit provided within the housing to generate a driving force; a rotating plate rotatably provided within the housing to be rotated by receiving the driving force; and a magnetic body coupled to both end portions of the rotating plate, respectively, to generate a magnetic force exerted from one side to the other side.

Here, a drive motor may be provided in the drive unit.

Furthermore, a driven gear may be coupled to a central shaft of the rotating plate, and the driven gear may be teeth combined with a driving gear of the drive motor to receive a rotational force of the drive motor so as to rotate the rotating plate.

Furthermore, the device may further include a controller configured to control the rotational speed of the drive motor so as to adjust the rotational speed, rotational direction and rotation angle of the rotating plate.

On the other hand, a device for cleaning contaminants on a contact portion of an electromagnetic contactor according to an embodiment of the present invention may further include a support provided at a lower portion of the housing to accommodate an electromagnetic contactor therein.

Furthermore, the support may be height adjustable.

According to a device for cleaning contaminants on a contact portion of an electromagnetic contactor in accordance with the present invention, a magnetic force the acting direction of which is changed in time may be generated to the outside of the electromagnetic contactor, thereby effectively performing the cleaning of contaminants on the contact portion thereof due to an arc extinction method.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
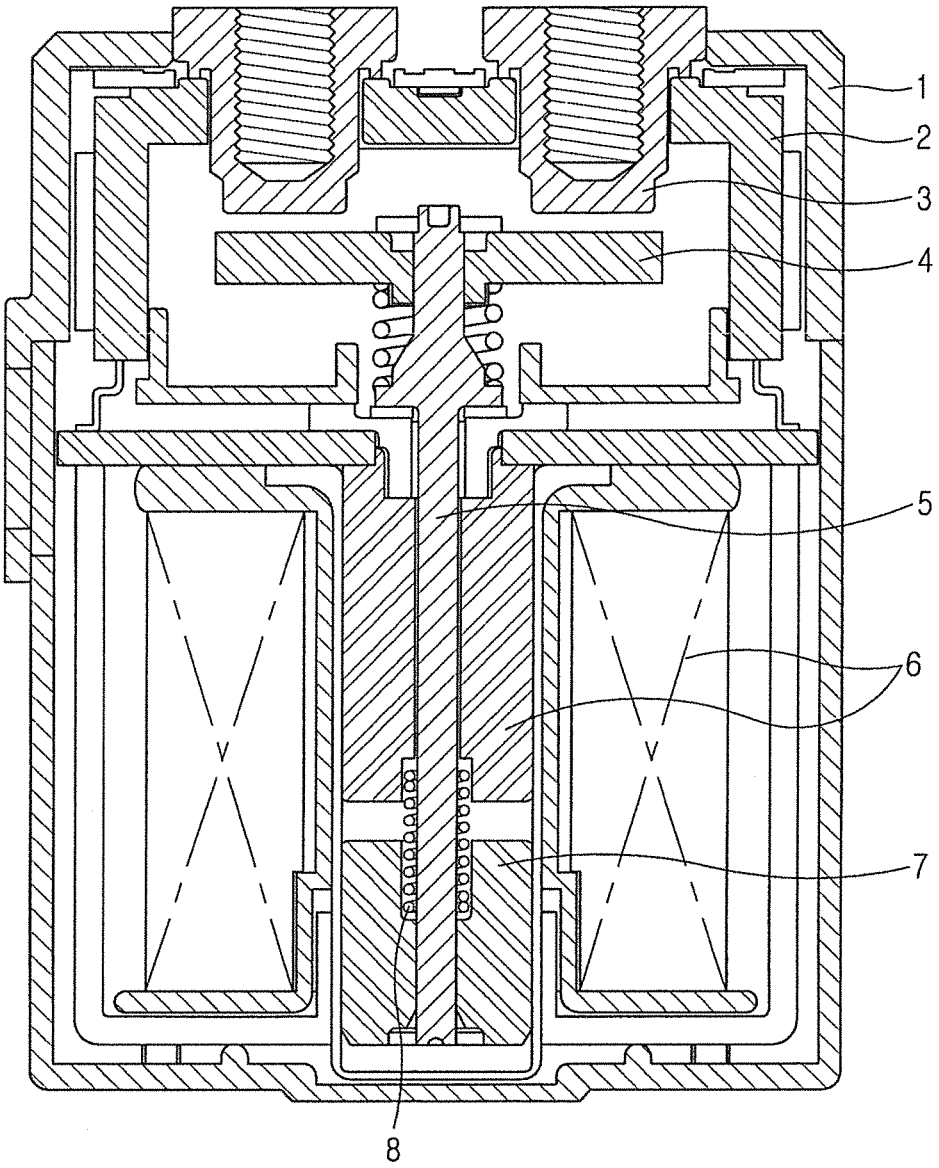
FIG. 1 Prior Art
FIG. 1 is a longitudinal cross-sectional view illustrating an inner portion of an electromagnetic contactor according to the related art.
Figure 2:
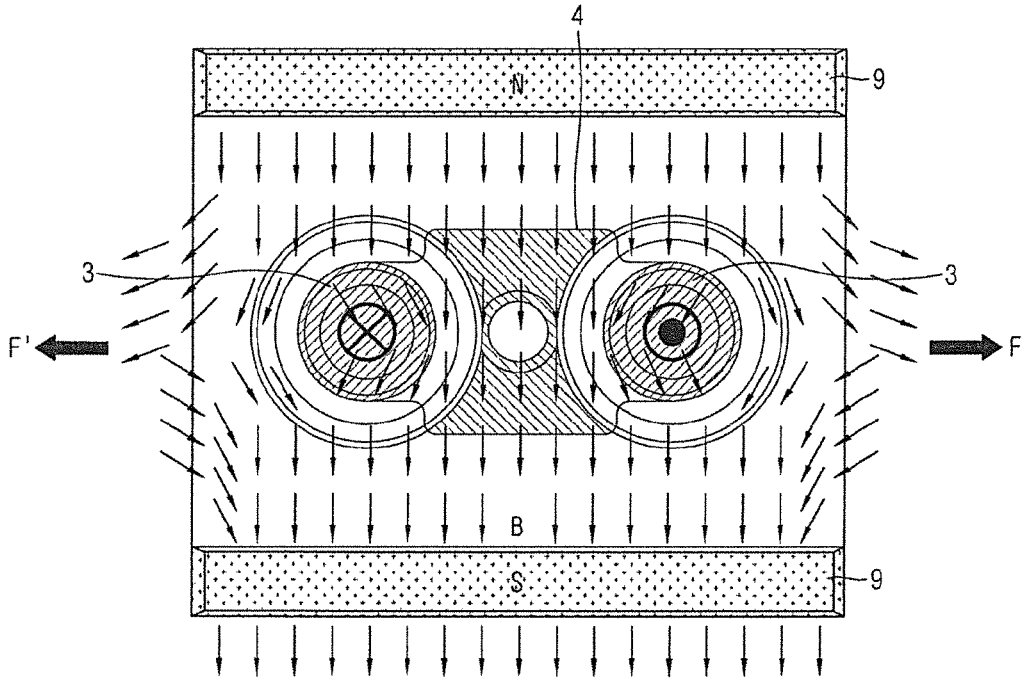
FIG. 2 Prior Art
FIG. 2 is a transverse cross-sectional view illustrating a method of cleaning contaminants on a contact portion of an electromagnetic contactor according to the related art.

Hereinafter, a preferred embodiment of the present invention will be described in detail with reference to the accompanying drawings to such an extent that the present invention can be easily implemented by a person having ordinary skill in the art to which the present invention pertains, but it does not mean that the technical concept and scope of the present invention are limited due to this.

A device for cleaning contaminants on a contact portion of an electromagnetic contactor according to an embodiment of the present invention may include a housing 10; a drive unit provided within the housing 10 to generate a driving force; a rotating plate 30 rotatably provided within the housing 10 to be rotated by receiving the driving force; a magnetic body 50 coupled to both end portions 31 of the rotating plate 30, respectively, to generate a magnetic force exerted from one side to the other side; and a plurality of supports 70 provided at a lower portion of the housing 10 to accommodate an electromagnetic contactor therein.

Figure 3:
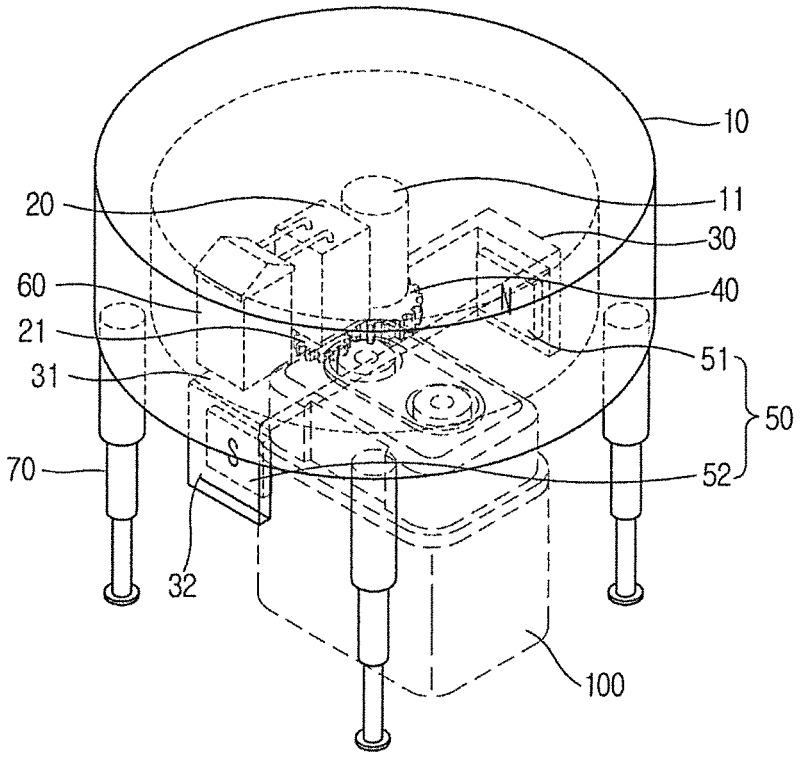
FIG. 3 is a perspective view illustrating a device for cleaning contaminants on a contact portion of an electromagnetic contactor according to the present disclosure.
Figure 4:
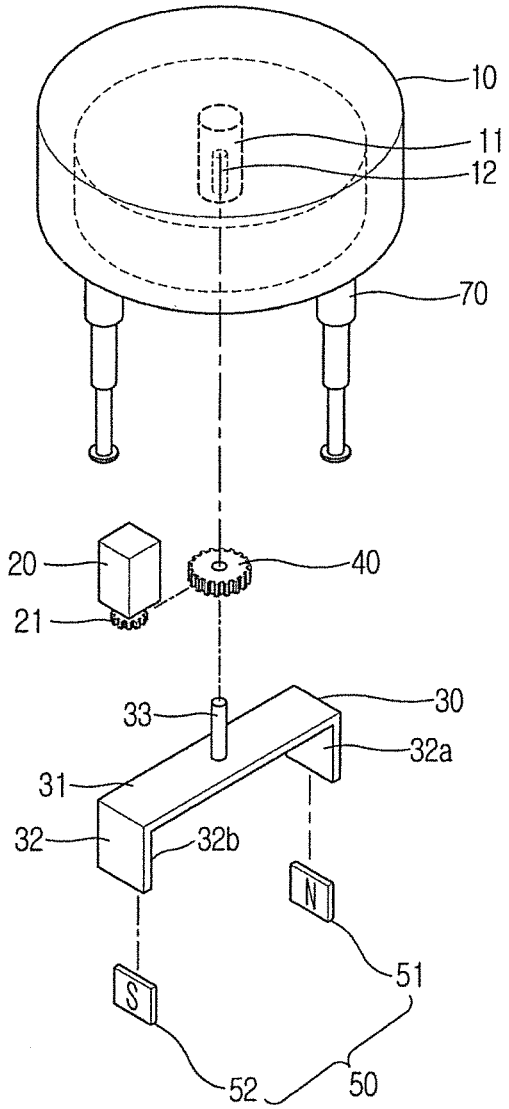
FIG. 4 is an exploded perspective view of FIG. 4.

FIG. 3 is a perspective view illustrating a device for cleaning contaminants on a contact portion of an electromagnetic contactor according to the present disclosure, and FIG. 4 is an exploded perspective view of FIG. 4. A device for cleaning contaminants on a contact portion of an electromagnetic contactor according to an embodiment of the present invention will be described in detail with reference to the drawings.

The housing 10 is formed in a substantially cylindrical shape with an opening lower portion. The upper surface of the housing 10 is formed with an area capable of accommodating an electromagnetic contactor, and the height thereof is formed with a predetermined length capable of accommodating a drive unit and a magnetic body 50 which will be described later. The housing 10 may be formed of a synthetic resin material due to molding injection. A supporting shaft 11 may be formed in a protruded manner at a central portion of the housing 10 to rotatably support the central shaft 33 of the rotating plate 30 which will be described later. A coupling groove 12 capable of fixing the central shaft 33 of the rotating plate 30 may be formed along a length direction thereof at the supporting shaft 11.

The drive unit is provided within the housing 10. The drive unit provides a rotational force to the rotating plate 30 which will be described later. A drive motor 20 may be provided in the drive unit. The drive motor 20 may be provided with an AC motor or DC motor to be suitable to a power source, and provided with a motor integrated with a reduction gear to adjust the rotational speed of the driving gear 21.

The rotating plate 30 is configured with a body portion 31 and a vane portion 32. The body portion 31 may be formed with a long rectangular plate shape. The central shaft 33 is vertically formed in a protruded manner at the center of the body portion 31. The central shaft 33 of the rotating plate 30 is inserted and combined with the coupling groove 12 of the supporting shaft 11 in the housing 10 and thus the rotating plate 30 is rotatably provided in the housing 10. Here, a bearing (not shown) may be interposed between the central shaft 33 and the coupling groove 12 to smoothly rotate the central shaft 33 of the rotating plate 30 with the support within the supporting shaft 11 of the housing 10.

The vane portions 32 of the rotating plate 30 are formed to be bent and extended in a vertically downward direction at both end portions of the body portion 31. Accordingly, the vane portions 32 vertically formed at both end portions of the body portion 31, respectively, are formed in the shape of facing each other. The vane portion 32 may be formed of the same material as that of the body portion 31.

The driven gear 40 is inserted into the central shaft 33. The driven gear 40 is fixed and coupled to the central shaft 33 of the rotating plate 30. The driven gear 40 is teeth combined with the driving gear 21 of the drive motor 20 to receive a rotational force of the drive motor 20 so as to rotate the rotating plate 30.

The magnetic body 50 is coupled to an inner lateral surface of the vane portion 32. An N-pole magnetic body 51 is adhered to one vane portion 32*a*, and a S-pole magnetic body 52 is adhered to the other vane portion 32*b* to generate a magnetic field (B) exerted from the one vane portion 32*a* to the other vane portion 32*b*.

The controller 60 may be provided in part of the housing 10. The controller 60 may be formed with a PCB board. The controller 60 may control the rotational speed of the drive motor 20 to control the rotational speed, rotational direction, rotation angle and the like of the rotating plate 30. As a method of controlling the rotational speed of the drive motor 20, a scheme for adjusting the voltage of the power source received at the drive motor 20 from the power supply unit may be used. The controller 60 may control the rotation angle of the rotating plate 30, thereby placing the vane portion 32 of the rotating plate 30 at a specific location. Accordingly, it may be possible to adjust the direction of a magnetic field (B) generated from the magnetic body 50.

On the other hand, according to another embodiment, the drive motor 20 may be formed with a stepper motor. In this case, the stepper motor may be rotated according to a preset angle even when an additional driven gear 40 or controller 60 is not provided therein, and accordingly, the rotating plate 30 may be sequentially rotated at a predetermined angle.

A plurality of supports 70 may be formed at a lower portion of the housing 10 to support the housing 10 while being separated from the ground. The support 70 may merely perform the role of a pedestal. According to another embodiment, the support 70 may be formed to be height adjustable. As an example, it is illustrated the support 70 formed in an inscribed slide manner such as antennas or camera tripods. An electromagnetic contactor with various sizes may be accommodated therein by adjusting the height of the support 70.

The operation of a device for cleaning contaminants on a contact portion of an electromagnetic contactor according to an embodiment of the present invention will be described with reference to FIG. 5.

An electromagnetic contactor 100 subject to the operation of cleaning contaminants is placed at a lower portion of the housing 10. The height of the support 70 is adjusted to place a portion having a stationary contact point 103 and a movable contact point 104 at the height of the N-pole and S-pole magnetic bodies 51, 52.

Power is supplied to the device, and power is also supplied to the electromagnetic contactor 100 to generate an arc. The arc generated from the electromagnetic contactor 100 is generated in such a form that it is started from any one (indicated by ⊙) of the stationary contact point 103 and enters into another one (indicated by ⊗) of the stationary contact point 103 while forming an arc shape. The arc receives forces (F, F') according to a magnetic force (B) generated from the N-pole and S-pole magnetic bodies 51, 52 to clean contaminants adhered to the contact portion.

Figure 5:
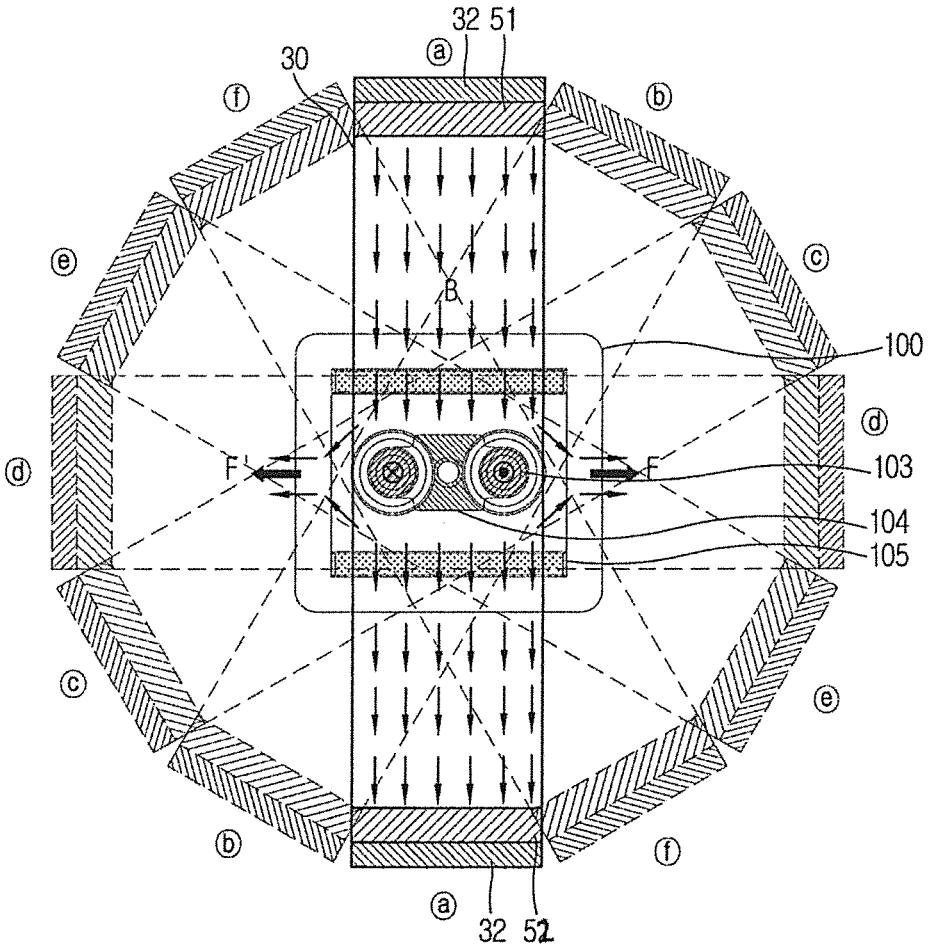
FIG. 5 is a transverse cross-sectional view illustrating the operation status of a device for cleaning contaminants on a contact portion of an electromagnetic contactor according to the present disclosure.

The operation of the controller 60 allows the rotating plate 30 to be rotated by each predetermined angle according to a change of time (for example, sequentially rotated with the location of ⓐ→ⓑ→ⓒ→ⓓ→ⓔ→ⓕ in FIG. 5), and the direction of the magnetic force (B) generated from the N-pole and S-pole magnetic bodies 51, 52 is also varied (changed in a clockwise direction based on the direction from the top to bottom in the example of FIG. 5). The direction of forces (F, F') received by an arc is also varied according to a change of the direction of the magnetic field (B), and thus the forces (F, F') are exerted on the entire surface of the stationary contact point 103 and movable contact point 104 to effectively clean contaminants.

A magnetic force (B) generated from the N-pole and S-pole magnetic bodies 51, 52 is added to a magnetic force generated from the magnetic body for arc extinction 105 provided within the electromagnetic contactor 100 to determine the resultant direction of the magnetic force (B). Here, when a magnetic force (B) generated from the N-pole and S-pole magnetic bodies 51, 52 is formed to be highly greater than that from the magnetic body for arc extinction 105, the resultant direction of the magnetic force (B) is substantially identical to the direction of a magnetic field (B) generated from the N-pole and S-pole magnetic bodies 51, 52.

Although the present invention has been described with reference to the foregoing preferred embodiments, it will be easily recognized by those skilled in the art that various modifications and changes can be made without departing from the gist and scope of the invention, and it should be also clearly understood that all these modifications and changes fall in the appended claims.

What is claimed is:

1. A device for cleaning contaminants on a contact portion of an electromagnetic contactor, the device comprising:

a housing;

a drive unit provided within the housing to generate a driving force;

a rotating plate rotatably provided within the housing to be rotated by receiving the driving force; and a N-pole magnetic body adhered to one end of the rotating plate and a S-pole magnetic body adhered to the other end of the rotating plate to generate a magnetic field between the one end of the rotating plate and the other end of the rotating plate, wherein the N-pole magnetic body is separated by a distance from the S-pole magnetic body, wherein a drive motor is provided in the drive unit.

2. The device of claim 1, wherein a driven gear is coupled to a central shaft of the rotating plate, and the driven gear is teeth combined with a driving gear of the drive motor to receive a rotational force of the drive motor so as to rotate the rotating plate.

3. The device of claim 2, further comprising:

a controller configured to control the rotational speed of the drive motor so as to adjust the rotational speed, rotational direction and rotation angle of the rotating plate.

4. The device of claim 1, further comprising:

a support provided at a lower portion of the housing to accommodate an electromagnetic contactor therein.

5. The device of claim 4, wherein the support is height adjustable.

* * * * *